US007257860B2

(12) United States Patent
Jankovich et al.

(10) Patent No.: US 7,257,860 B2
(45) Date of Patent: Aug. 21, 2007

(54) BRAKE MECHANISM

(75) Inventors: Daniel L. Jankovich, Minneapolis, MN (US); Mark N. Manzella, Maplewood, MN (US); Philip A. Billings, Shoreview, MN (US)

(73) Assignee: Reell Precision Manufacturing Corporation, St. Paul, MN (US)

( * ) Notice: Subject to any disclaimer, the term of this patent is extended or adjusted under 35 U.S.C. 154(b) by 0 days.

(21) Appl. No.: 10/900,828

(22) Filed: Jul. 28, 2004

(65) Prior Publication Data

US 2005/0076472 A1 Apr. 14, 2005

Related U.S. Application Data

(60) Provisional application No. 60/591,342, filed on Jul. 27, 2004, provisional application No. 60/576,493, filed on Jun. 3, 2004, provisional application No. 60/510,978, filed on Oct. 13, 2003.

(51) Int. Cl.
*E05F 5/02* (2006.01)
*E05C 17/22* (2006.01)

(52) U.S. Cl. ..... 16/82; 16/86 C

(58) Field of Classification Search ..... 16/82, 16/85, 86 R, 86 A, 86 B, 86 C; 109/63.5, 109/60; 292/341.12, 340, 302, 306
See application file for complete search history.

(56) References Cited

U.S. PATENT DOCUMENTS 935,545 A * 9/1909 Pilcher ..... 292/306
2,915,777 A 12/1959 Allen
2,915,778 A * 12/1959 De Vito ..... 16/82
5,675,869 A * 10/1997 Lotz ..... 16/334
5,862,570 A * 1/1999 Lezuch et al. ..... 16/82
6,044,934 A * 4/2000 Nemeth ..... 188/67
6,499,568 B1 * 12/2002 Nemeth ..... 188/67
6,557,924 B2 5/2003 Lauderbach et al.
6,606,763 B1 8/2003 Brückner
6,701,576 B2 3/2004 Michalak
6,739,020 B1 5/2004 Morawetz
6,901,630 B2 * 6/2005 Liang et al. ..... 16/82

FOREIGN PATENT DOCUMENTS

| | | |
|---|---|---|
| DE | 462915 | 7/1928 |
| DE | 25 55 756 | 6/1977 |
| DE | 2555756 A * | 6/1977 |
| DE | 199 06 708 | 8/2000 |
| DE | 199 21 213 | 11/2000 |
| DE | 202 16 284 | 2/2003 |
| EP | 0 952 289 | 10/1999 |
| FR | 2 830 893 | 4/2003 |

OTHER PUBLICATIONS

PCT International Search Report for International Application No. PCT/US2004/024831 mailed on May 4, 2005 (8 pages).

* cited by examiner

*Primary Examiner*—Chuck Y. Mah
(74) *Attorney, Agent, or Firm*—Dicke, Billig & Czaja, PLLC

(57) ABSTRACT

A brake mechanism includes an input, a chassis, a lock and a release mechanism. The input is an axially extending input having first and second ends. The chassis interfaces with the input such that the input is movable relative to the chassis. The lock is coupled to the chassis for constraining movement of the input relative to the lock. The release mechanism is coupled to the lock and is responsive to a force applied relative to the input and the chassis such that when the force is greater than a release force level the release mechanism allows the lock to disengage the input and such that when the force is less than the release force level the release mechanism does not allow the lock to disengage the input.

26 Claims, 13 Drawing Sheets

BRAKE MECHANISM

CROSS REFERENCE TO RELATED APPLICATIONS

This Non-Provisional Patent Application claims the benefit of the filing dates of U.S. Provisional Patent Application Ser. No. 60/510,978, filed Oct. 13, 2003, entitled "DOOR BRAKE;" U.S. Provisional Patent Application Ser. No. 60/576,493, filed Jun. 3, 2004, entitled "DOOR BRAKE," and U.S. Provisional Patent Application Ser. No. 60/591,342, filed Jul. 27, 2004, entitled "DOOR BRAKE;" each of which are herein incorporated by reference.

BACKGROUND

The present invention relates to a brake mechanism, and in particular, a brake mechanism that may be configured to controllably regulate the motion of one body relative to another. Brake mechanisms may be used in various applications, for example, in automobile door applications. In such applications, it may be desirable to provide a brake for holding one movable member relative to another. Such a mechanism allows the user to position a movable member at any of a variety of positions relative to another. For example, a brake mechanism allows a door of an automobile to be held between open and closed.

In many automotive designs, a brake mechanism utilizes discrete detent holding positions. In this way, a door or similar movable element may be positioned and held at various discrete locations between fully opened and closed. At any of these discrete locations, the door will remain in a relatively "locked" state until the user applies the necessary force to move the door. Upon surpassing this force at the detent position, the door moves more easily. With such mechanisms, holding the door or hinged element at a location between fully opened and closed other than at one of the discrete detent holding positions is not readily achievable. If the user wishes to hold the door at such a location, they must physically hold it there. For these and other reasons, a need exists for the present invention.

SUMMARY

One aspect of the present invention provides a brake mechanism. The brake mechanism includes an input, a chassis, a lock and a release mechanism. The input is an axially extending input having first and second ends. The chassis interfaces with the input such that the input is movable relative to the chassis. The lock is coupled to the chassis for constraining movement of the input relative to the lock. The release mechanism is coupled to the lock and is responsive to a force applied relative to the input and the chassis such that when the force is greater than a release force level the release mechanism allows the lock to disengage the input and such that when the force is less than the release force level the release mechanism does not allow the lock to disengage the input.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
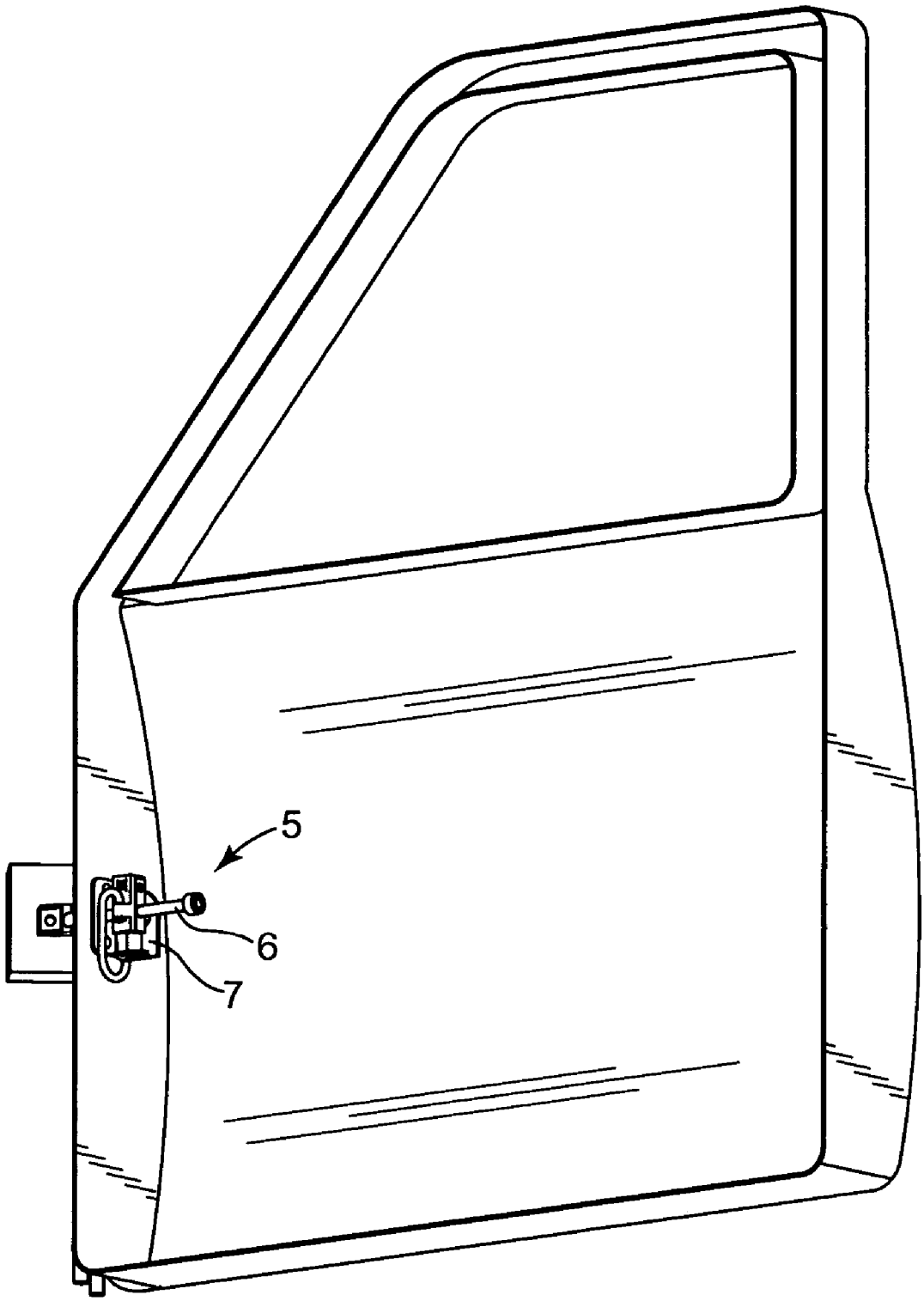
FIG. 1 illustrates a brake mechanism in accordance with one embodiment of the present invention.

FIG. 1 illustrates brake mechanism 5 configured in a hinge arrangement in accordance with the present invention. Brake mechanism 5 is illustrated mounted to an automobile door, which is hinged to a frame. Brake mechanism 5 may be used in any variety of applications that move one body relative to another consistent with the present invention. The automobile door and frame are but one illustration of an embodiment of brake mechanism 5.

Brake mechanism 5 includes input 6 and housing 7. Input 6 is an axially extending member that is coupled at one end to the frame. Input 6 then extends through housing 7. Housing 7 is mounted to the door. In operation, the automobile door is hinged to the frame with a hinge or multiple hinges. Brake mechanism 5 may then be used to controllably regulate the motion of the door relative to the frame. For example, brake mechanism 5 can controllably regulate the amount of force it takes to move the door relative to the frame, such as how much force it takes to open or close the door.

In this way, when the door is open relative to the frame and a relatively small amount of force is applied to the door in order to close it, brake mechanism 5 engages such that the door will not be allowed to move toward the closed position. When an increased amount of force is applied to the door, however, brake mechanism 5 disengages such that the door is allowed to move toward the closed position. When the force is removed or decreased below a certain level, brake mechanism 5 again engages such that the door will not be allowed to move. In one embodiment, the amount of force below which brake mechanism 5 engages and above which brake mechanism 5 disengages, is the release force. The release force can be adjusted by the configuration of brake mechanism 5 such that the amount of force required to open and close the door will vary for the particular application.

The door can be braked at any position between open and closed, as there are no set positions or detents at which brake mechanism 5 engages or disengages. The engagement or disengagement of brake mechanism 5 is determined by the force applied to the door, and thus, can be independent of the relative position of the door between open and closed.

Figure 2:
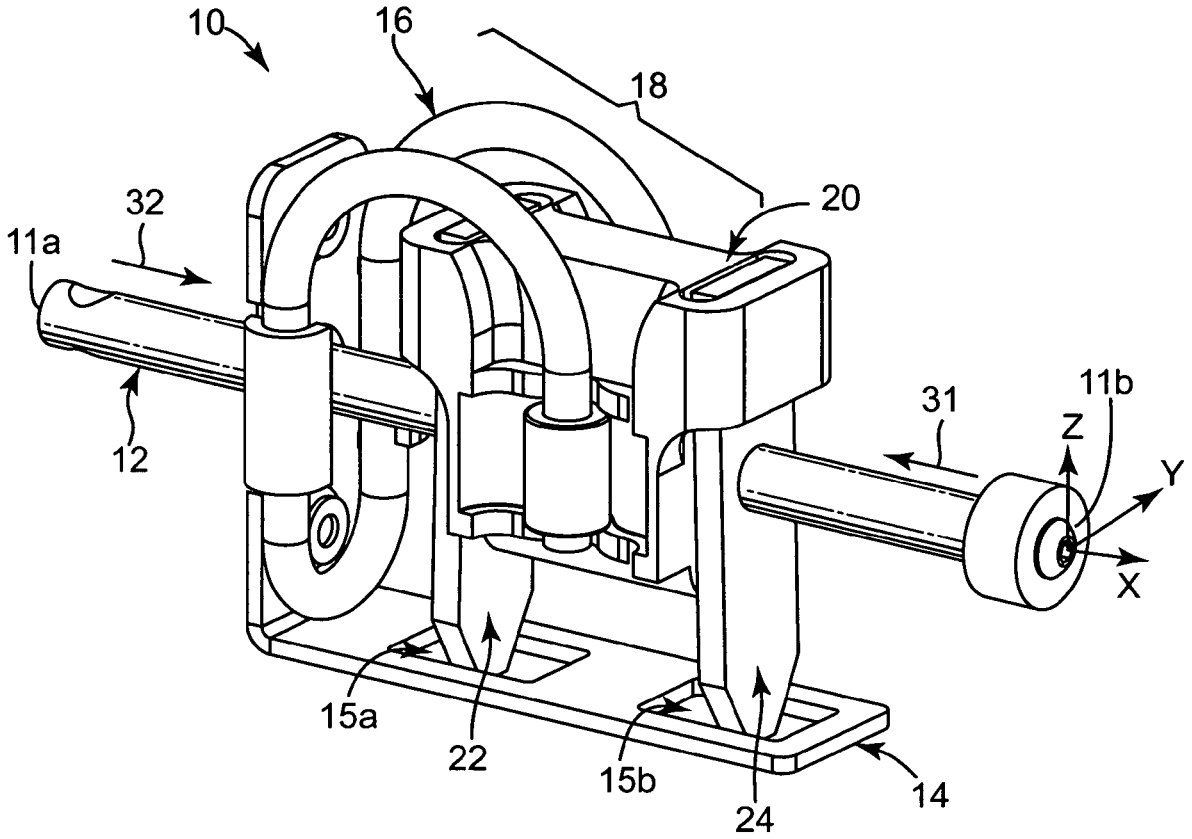
FIG. 2 illustrates one embodiment of a brake mechanism in accordance with the present invention.

FIG. 2 illustrates details of a brake mechanism 10 in accordance with the present invention. Brake mechanism 10 includes input 12, chassis 14, spring 16 and lock assembly 18. Lock assembly 18 is configured within chassis 14 and further includes lock holder 20, first and second locking plates 22 and 24, and bias spring 26 (not visible in FIG. 2). Chassis 14 includes openings 15*a* and 15*b* through which first and second locking plates 22 and 24 extend, respectively. Spring 16 is coupled to chassis 14.

In one embodiment, brake mechanism 10 is used in conjunction with a door that is hinged relative to a doorframe in order to control the movement of the door relative to the doorframe. The input to brake mechanism 10 is through input 12, which has a first end 11*a* and a second end 11*b*. First end 11*a* may be pinned or otherwise coupled to the stationary doorframe, while the second end 11*b* is passes through lock assembly 18. Chassis 14 is then mounted to the door. It can be mounted with mounting screws, rivets, or any of a variety of mechanisms to couple chassis 14 to the door. Under certain conditions, input 12 moves axially through lock assembly 18 as the door opens and closes relative to the doorframe. The second end 11*b* of input 12 may also be provided with a stop to prevent lock assembly 18 from sliding off of input 12 when in use. In another embodiment, chassis 14 is coupled to the stationary doorframe, while input 12 pinned to the door.

Lock assembly 18 includes lock holder 20, first and second locking plates 22 and 24, and bias spring 26. Input 12 passes through both first and second locking plates 22 and 24, each of which have openings with a clearance fit about input 12. First and second locking plates 22 and 24 are offset with respect to input 12 such that, under certain conditions, lock assembly 18 grips or locks onto input 12, thereby preventing axial movement of input 12 relative to lock assembly 18. In one embodiment, both first and second locking plates 22 and 24 are each tipped at a small angle with respect to input 12, by bias spring 26. Other means of locking first and second locking plates 22 and 24 to input 12 are possible consistent with the present invention. In the illustrated embodiment, each of first and second locking plates 22 and 24 may engage or lock to input 12 in only one direction of axial movement of input 12.

Brake mechanism 10 has two states: engaged and disengaged. In the engaged state, or the steady state, first and second locking plates 22 and 24 grip input 12 at their respective opening through which input 12 extends such that a load applied to input 12 in either direction is entirely transferred through either first or second locking plate 22 or 24 to lock holder 20. In the disengaged state, or the transient state, an external force is applied to either first or second locking plate 22 or 24. This external-applied force releases the grip of first or second locking plate 22 or 24 on input 12 and sends brake mechanism 10 into a slip condition. In this slip condition, input 12 slips through both first and second locking plates 22 and 24. Brake mechanism 10 is designed to be self-locking. Therefore, brake mechanism 10 will not slip under load until released.

In the illustrated embodiment, first and second locking plates 22 and 24 are either leading or trailing locks, depending upon the direction of the applied load or force. The leading lock is the locking plate 22 or 24 that is dominant, relative to the other, in its grip on input 12. The leading lock transfers most of the load applied to input 12 to lock holder 20. In this way, the leading lock and input 12 act as a rigid body and will move together. The trailing lock will also move as it is constrained by lock holder 20, yet will not transmit a significant load. In the embodiment illustrated in FIG. 2, first locking plate 22 is the leading lock when a load is applied in the direction of arrow 31, while second locking plate 24 is the trailing lock. When a load is applied in the direction of arrow 32, second locking plate 24 is the leading lock, while first locking plate 22 is the trailing lock.

Figure 3:
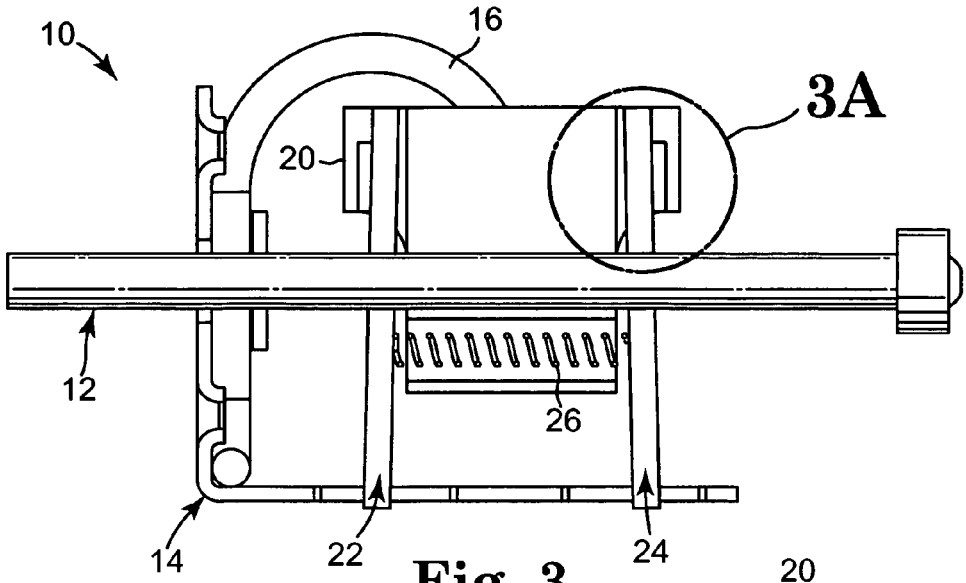
FIG. 3 illustrates a cross-sectional view of the brake mechanism of FIG. 2.
Figure 3A:
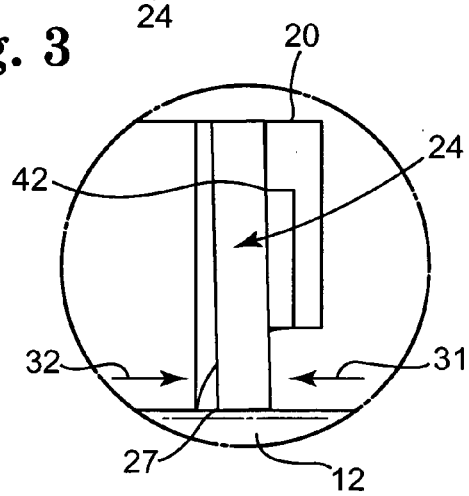
FIG. 3A illustrates a detailed view of a portion of the cross-sectional view illustrated in FIG. 3.

FIG. 3 is a cross-sectional view of brake mechanism 10 further illustrating the interaction of first and second locking plates 22 and 24 with respect to input 12. FIG. 3A illustrates a detailed view of brake mechanism 10 adjacent the intersection of input 12 with second locking plate 24. Input 12 extends through an opening in second locking plate 24. Lock holder 20 has a slot for receiving second locking plate 24 (and another for receiving first locking plate 22). The slots within lock holder 20 for receiving the first and second locking plates 22 and 24 are slightly larger than the width of the locking plates so that the locking plates can move within lock holder 20.

As indicated, depending on the direction of force applied to input 12, one of the locking plates will be leading and the other trailing. In the detailed view illustrated in FIG. 3A, arrow 32 indicates a locked direction where second locking plate 24 is the leading lock. In other words, when input 12 is moved in the direction indicated by arrow 32, second locking plate 24 grips input 12 as indicated by the locking plate contact arrow 27. Similarly, second locking plate 24 grips input 12 below input 12 on the other side of second locking plate 24 (not visible in FIG. 3A). Lock contact 42 is identified in a slot of lock holder 20 in the detailed view of the intersection of second locking plate 24 with lock holder 20. In FIG. 3A, arrow 31 indicates a slip direction where second locking plate 24 is the trailing lock. In other words, when input 12 is moved in the direction indicated by arrow 31, second locking plate 24 slips relative to input 12 when brake mechanism 10 is in a disengaged state. Because first locking plate 22 is a symmetrical mirror-image of second locking plate 24, the locked and slip directions of first locking plate 22 are the opposite of those indicated for second locking plate 24.

Figure 4:
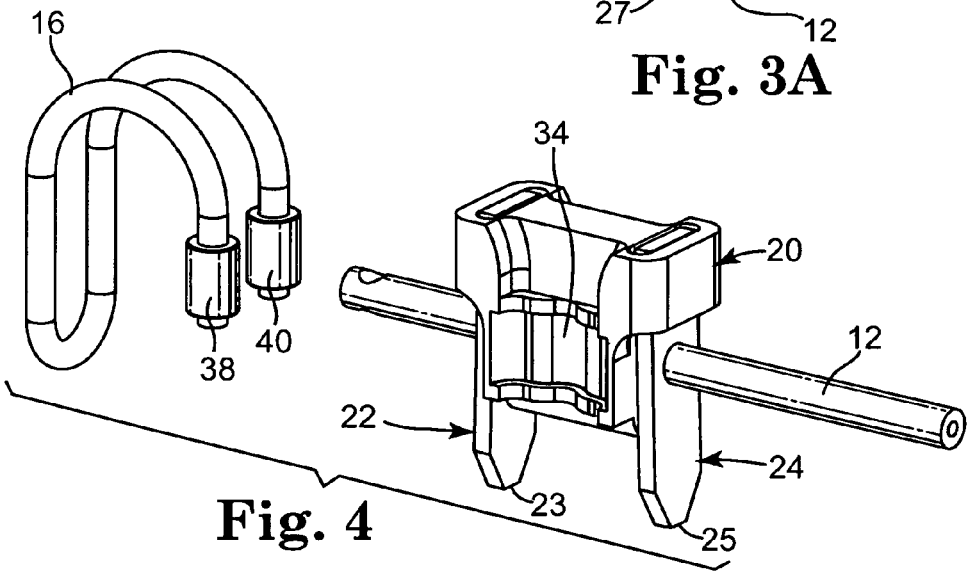
FIG. 4 illustrates a partially exploded view of a portion of the brake mechanism illustrated in FIG. 2.

FIG. 4 illustrates a portion of brake mechanism 10 in a partially exploded view. Spring 16 is illustrated disassembled from lock holder 20. First and second locking plates 22 and 24 each extend into lock holder 20, and are secured at lock holder 20 via input 12 extending through openings in the plates. The other ends of first and second locking plates 22 and 24 extend out from lock holder 20 and terminate in first and second plate tips 23 and 25.

Lock holder 20 includes first and second detents 34 and 36 in its sides (second detent 36 is not visible in FIG. 4, but lock holder 20 is symmetrical such that second detent 36 is the mirror image of first detent 34.) Each of the sides of lock holder 20 are angled or ramped relative to first and second detents 34 and 36. Spring 16 is provided with first and second rollers 38 and 40, which are configured to move along the ramped surfaces of lock holder 20 and into first and second detents 34 and 36.

When fully assembled, first and second rollers 38 and 40 rest in first and second detents 34 and 36, respectively. Spring 16 is a force generator that compresses either side of lock holder 20 via first and second rollers 38 and 40 with a compression force. When first and second rollers 38 and 40 are resting in first and second detents 34 and 36 (referred to as the "home position" for lock holder 20), brake mechanism 10 is normally engaged and input 12 does not move relative to chassis 14 when no force, or only a small force, is applied to input 12. When first or second locking plate 22 or 24 is locked to input 12, lock holder 20 will be forced to move axially with input 12 when input 12 is moved. Because spring 16 is coupled to chassis 14, when a sufficient force is applied axially to input 12 the ramped surfaces of lock holder 20 will deflect spring 16 via rollers 38 and 40. The amount of force that must be applied to input 12 in order to deflect spring 16 via rollers 38 and 40 is the release force.

When lock holder 20 is moved in the direction indicated by arrow 32 in FIGS. 2 and 3, second locking plate 24 is the leading lock. Because brake mechanism 10 is engaged, leading lock (second locking plate 24) moves with input 12, as does lock holder 20. As each move in the direction of arrow 32, second plate tip 25 of the leading lock, which extends through opening 15*b* (illustrated in FIG. 2) will impact chassis 14. This applies an external force to second locking plate 24 at second plate tip 25. Application of this force will cause second locking plate 24 to slip relative to input 12, thereby disengaging brake mechanism 10. In this disengaged state, input 12 may move relative to chassis 14 and lock assembly 18, subject to a drag force caused be some continued contact from first and second locking plates 22 and 24.

One way for brake mechanism 10 to return to its steady state position is for input 12 to travel slightly in the direction of arrow 31 such that lock holder 20 can return to its home position. In embodiments where input 12 is coupled to a door, the door will return slightly in the direction opposite that it was being forced in order for brake mechanism 10 to return to its engaged state. It is not necessary to apply an external force to input 12 in this return direction, because once a force is removed from input 12, the compression force from spring 16 will cause first and second rollers 38 and 40 to move along the sides of lock holder 20 and into first and second detents 34 and 36, thereby returning lock holder 20 back to its home position. Because the sides of lock holder 20 are contoured on either side of detents 34 and 36, the compression force delivered by spring 16 has both an x-axis and y-axis component. In one embodiment, the drag force caused by the locks on input 12 is less than the x-axis component of the compression force from spring 16. Thus, slight movement of input 12 in the direction opposite that of the direction that caused the disengagement is necessary to reset or reengage brake mechanism 10.

Consequently, when brake mechanism 10 is installed on a door that is hinged to a frame, at any location of the door relative to the frame, the door will be held in a locked state while brake mechanism 10 is engaged. When the user applies enough force, that is, more than the release force to disengage brake mechanism 10, the door moves easily subject only to system drag and inertia. When the applied force is removed from the door, lock holder 20 moves back to its home position, thereby reengaging brake mechanism 10.

In an alternative embodiment, brake mechanism may be reset externally after it is disengaged, that is, lock holder 20 may be moved back to its home position to reengage brake mechanism 10. In this way, again using FIG. 3 as an illustration, when lock holder 20 is moved in the direction indicated by arrow 32 such that second locking plate 24 impacts chassis, brake mechanism 10 will disengage. Rather than having input 12 return a slight distance in the direction indicated by arrow 31, brake mechanism 10 can be reset and reengaged by application of an external force on second locking plate 24. Application of this external force decreases the drag force of second locking plate 24 below the x-axis component of the compression force from spring 16 thereby allowing lock holder 20 to move back to its home position.

Application of a force on second locking plate 24 to reset brake mechanism could be accomplished in a variety of ways consistent with the present invention. A solenoid or similar actuating device could be triggered at the appropriate time to transition against first or second locking plate 22 or 24 (depending on which is the leading plate at that time) such that brake mechanism is reset. Similarly a pin or other mechanism could be used to apply an external force to first or second locking plate 22 or 24.

The amount of compression force exerted by spring 16 on lock holder 20 is proportional to the amount of force (the release force) that must be applied to input 12 in order to move lock holder 20 forward until the leading lock (and specifically, first or second plate tip 23 or 25) impacts chassis 14, thereby disengaging brake mechanism 10. Again, the amount of force that must be applied to input 12 in order to disengaging brake mechanism 10 is the release force. When a force less than the release force is applied to input 12, brake mechanism 10 remains engaged. When a force greater than the release force is applied to input 12, brake mechanism 10 disengages. Because the release force is proportional to the compression force exerted by spring 16 on lock holder 20, the release force in brake mechanism 10 is adjustable for particular applications by adjustments to the compression force of spring 16. In this way, adjustments may be made to spring 16 so that the release force may be tailored to the particular application of brake mechanism 10. In addition, or as an alternative, the shape and contour of the sides of lock holder 20 can be adjusted so that release force is increased (such as increasing the pitch of the sides) or decreased. Very similarly, the return force, that is, the force that allows lock holder 20 to move back to its home position upon reset, may also be adjusted with adjustments to the shape and contour of the sides of lock holder 20.

In another embodiment, brake mechanism 10 is designed with a force-free zone. In this design, brake mechanism 10 is configured to disable one or both of locking plates 22 and 24 over a specified range. Such an override feature provides the user with a load-free zone, which may be desirable within a particular range, such as fully closed in a door application, or elsewhere. With this embodiment, a pin, solenoid or other mechanism can be used to apply a force to first or second locking plate 22 or 24 such that brake mechanism 10 is released or reset, and such that lock holder 20 moves back to its home position similar to that described previously. As first or second locking plate 22 or 24 is held in this orientation, no locking will be permitted, thus input 12 may move through lock assembly 18 with minimal drag.

Such a load free-zone may also utilize a variety of optical, electrical, mechanical or related sensors. The sensors can sense the force and/or movement of one body relative another, such as an automobile door to a frame. The sensors may then actuate a solenoid, pin or other device to reset brake mechanism 10 in certain ranges that are sensed by the sensor.

In an alternative embodiment of brake mechanism 10, a load free-zone may be accomplished in accordance with the invention by utilizing a tapered or stepped input 12. In this way, brake mechanism 10 would operated essentially as described previously, however, when the smaller diameter of input 12, either the tapered or stepped down portion, is encountered by first or second locking plates 22 or 24, locking plates 22 or 24 will release input 12 allowing lock holder 20 to move back to its home position and thus, input 12 may move through lock assembly 18 with minimal drag.

In an alternative embodiment of brake mechanism 10, a bi-directional brake may be achieved with one locking plate interacting with appropriate force transfer and release features at either end. In other words, a pin, solenoid or other actuating mechanism can be used to press a locking plate into and out of locking position to engage and disengage brake mechanism 10. The actuating mechanism could be controlled by a positioning sensor to appropriately engage and disengage brake mechanism 10 at the desired relative positions, while having only a single locking plate.

In an alternative embodiment of brake mechanism 10, chassis 14 may be configured as an articulating or pivoting chassis. This configuration can be useful when brake mechanism 10 is installed on two relative-moving bodies for alignment purposes as one body moves relative to the other. In addition, one skilled in the art will see that alternative force generators to spring 16 may be used consistent with the present invention. For example, a leaf spring or other force generator could be fixed to chassis 14 and engage rollers against the sides of lock holder 20.

Figure 5:
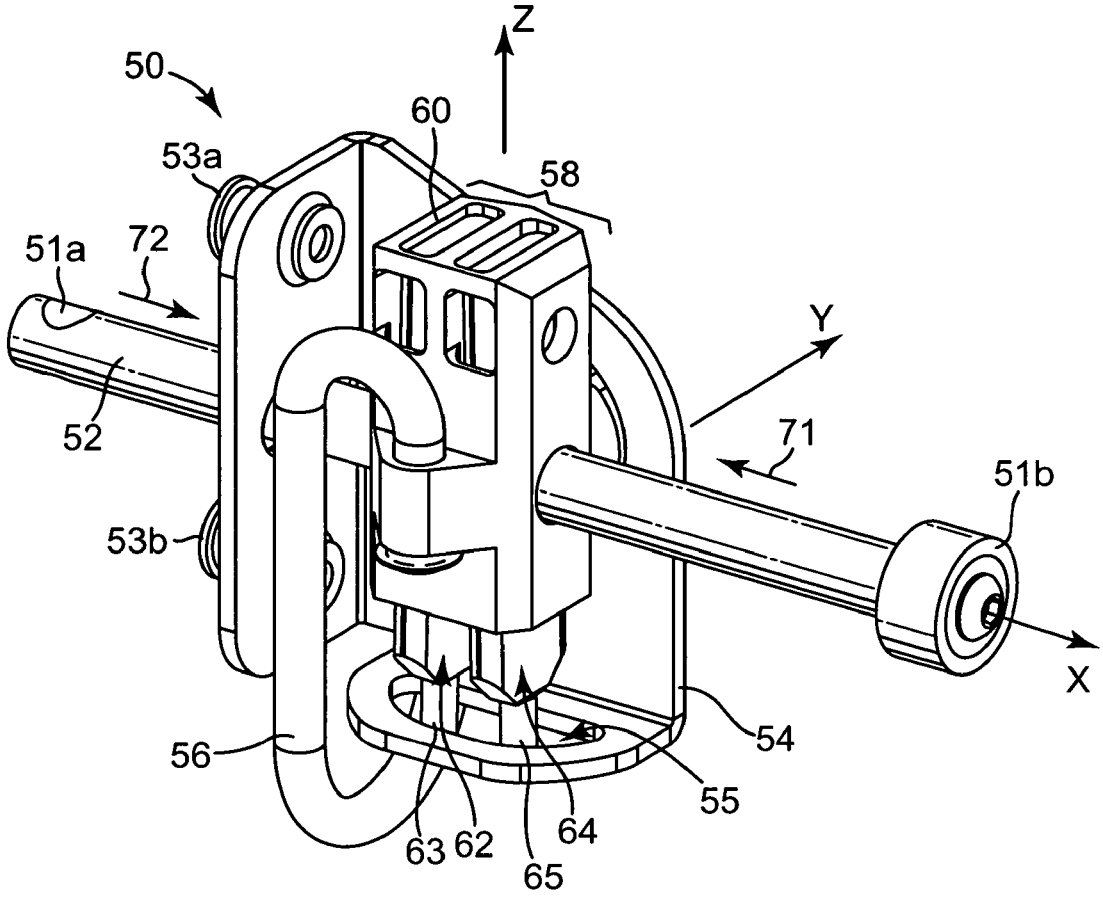
FIG. 5 illustrates an alternative embodiment of a brake mechanism in accordance with the present invention.

FIG. 5 illustrates brake mechanism 50 in accordance with an alternative embodiment of the present invention. Brake mechanism 50 includes input 52, chassis 54, spring 56 and lock assembly 58. Lock assembly 58 is configured within chassis 54 and further includes lock holder 60, first and second locking plates 62 and 64, and bias spring 66 (not visible in FIG. 5). Chassis 54 includes release opening 55 through which first and second locking plates 62 and 64 extend. Spring 56 is coupled to chassis 54.

In one embodiment, brake mechanism 50 is used in conjunction with a door that is hinged relative to a doorframe in order to control the movement of the door relative to the doorframe. In one embodiment, the input to brake mechanism 50 is through input 52, which includes pivot 51*a* at one end and limit stop 51*b* at another. Pivot 51*a* may be pinned to the stationary doorframe with a pin or similar mechanism and input 52 extends through lock assembly 58 from there. Mounting screws 53*a* and 53*b* may be used to mount chassis 54 to the door or to the interior of the door. As with brake mechanism 10, brake mechanism 50 may be configured so that chassis 54 is coupled to the stationary doorframe, while input 52 pinned to the door.

Lock assembly 58 includes lock holder 60 and first and second locking plates 62 and 64. Input 52 passes through both first and second locking plates 62 and 64, each of which have openings with a clearance fit about input 52. First and second locking plates 62 and 64 are offset with respect to input 52 such that, under certain conditions, lock assembly 58 grips or locks onto input 52, thereby preventing axial movement of input 52 relative to lock assembly 58. In one embodiment, first and second locking plates 62 and 64 are spring loaded with respect to each other via bias spring 66 (not visible in FIG. 5.) In this way, both first and second locking plates 62 and 64 are each tipped at a small angle, with respect to each other and input 52, by bias spring 66. Other means of locking first and second locking plates 62 and 64 to input 52 are possible consistent with the present invention. In the illustrated embodiment, each of first and second locking plates 62 and 64 may engage or lock to input 52 in only one direction of axial movement of input 52.

As with brake mechanism 10, brake mechanism 50 has an engaged state and a disengaged state. In the engaged or steady state, first and second locking plates 62 and 64 grip input 52 such that a load applied to input 52 in either direction is entirely transferred through either first or second locking plate 62 or 64 to lock holder 60. In the disengaged or transient state, an external load is applied to either first or second locking plate 62 or 64 thereby releasing the grip on input 52 and sending brake mechanism 50 into a slip condition. In this slip condition, input 52 slips through both first and second locking plates 62 and 64. As was the case with brake mechanism 10, one of locking plates 62 or 64 will be the leading lock while the other is the trailing lock, depending upon the direction of the applied load or force.

Figure 6:
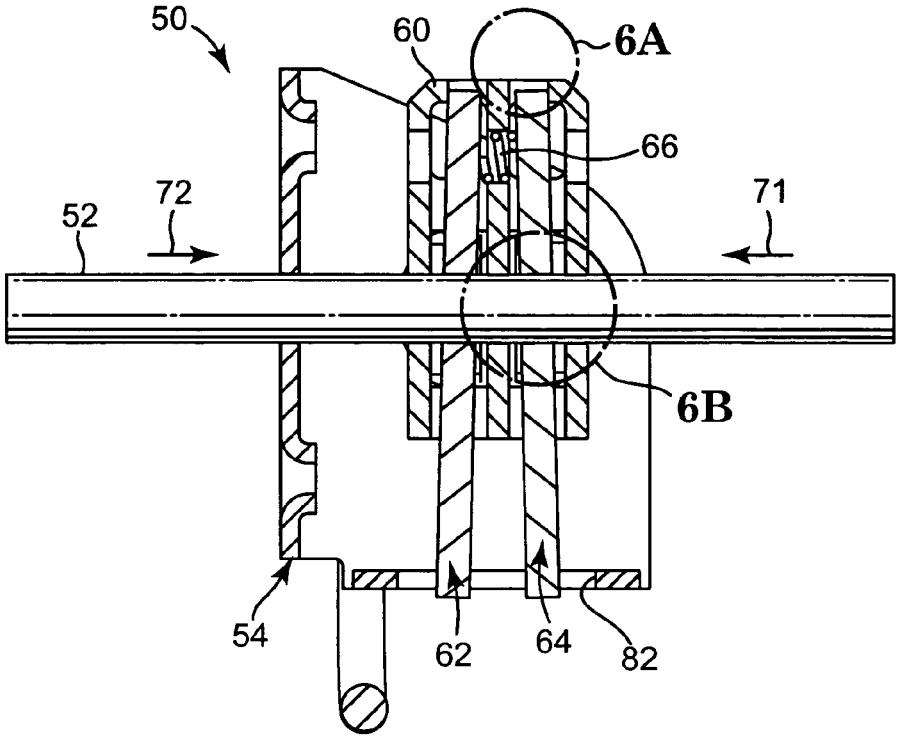
FIG. 6 illustrates a cross-sectional view of the brake mechanism of FIG. 5.
Figure 6A:
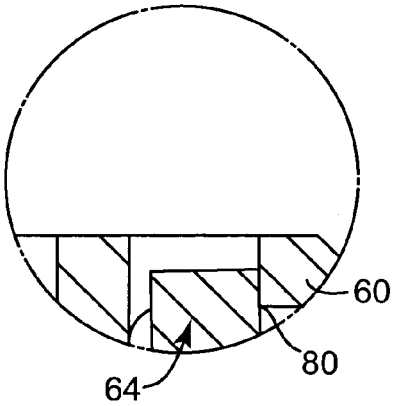
FIGS. 6A and 6B illustrate detailed views of portions of the cross-sectional view illustrated in FIG. 6.
Figure 6B:
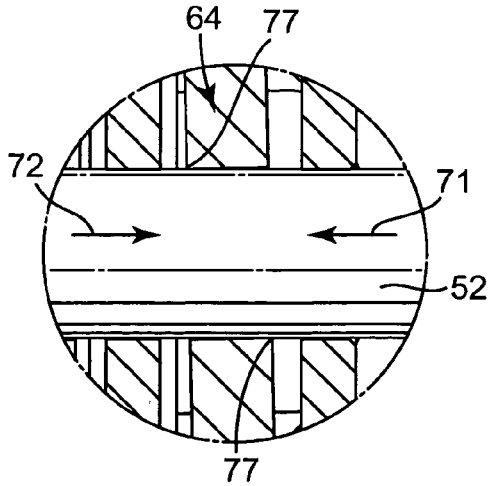

FIG. 6 is a cross-sectional view of brake mechanism 50 further illustrating the interaction of first and second locking plates 62 and 64 with respect to input 52 and lock holder 60. FIG. 6A illustrates a detailed view of a portion of brake mechanism 50 adjacent the intersection of second locking plate 64 with lock holder 60. FIG. 6B illustrates a detailed view of a portion of brake mechanism 50 adjacent the intersection of input 52 with second locking plate 64. Input 52 extends through openings in first and second locking plates 62 and 64. Lock holder 60 has slots for receiving first and second locking plate 62 and 64. Lock contact 80 is identified in this slot as in the detailed view of the intersection of second locking plate 64 with lock holder 60. Bias spring 66 is located between input 52 and lock contact surface 80. In this way, first and second locking plates 62 and 64 are kept at slight angles off of vertical relative to input 52 and thereby grip input 52 under any load. Bias spring 66 is illustrated pressing second locking plate 64 against lock contact surface 80, and bias spring 66 similarly presses first locking plate 62 in the opposite direction.

In the detailed view illustrated in FIG. 6B, a locked condition is indicated when force is applied in direction 72 and second locking plate 64 is the leading lock. In other words, when force is applied to input 52 in the direction indicated by arrow 72, second locking plate 64 grips input 52 as indicated by the locking plate contact arrows 77. In FIG. 6B, a slip condition is indicated when force is applied in direction and second locking plate 64 is the trailing lock. In other words, when force is applied to input 52 in the direction indicated by arrow 71, second locking plate 64 slips relative to input 52 when brake mechanism 50 is disengaged. Because first locking plate 62 is a symmetrical mirror-image of second locking plate 64, the locked and slip directions of first locking plate 62 are the opposite of those indicated for second locking plate 64. Brake mechanism 50 is designed to be self-locking. Therefore, brake mechanism 50 will not slip under load until released.

Figure 7:
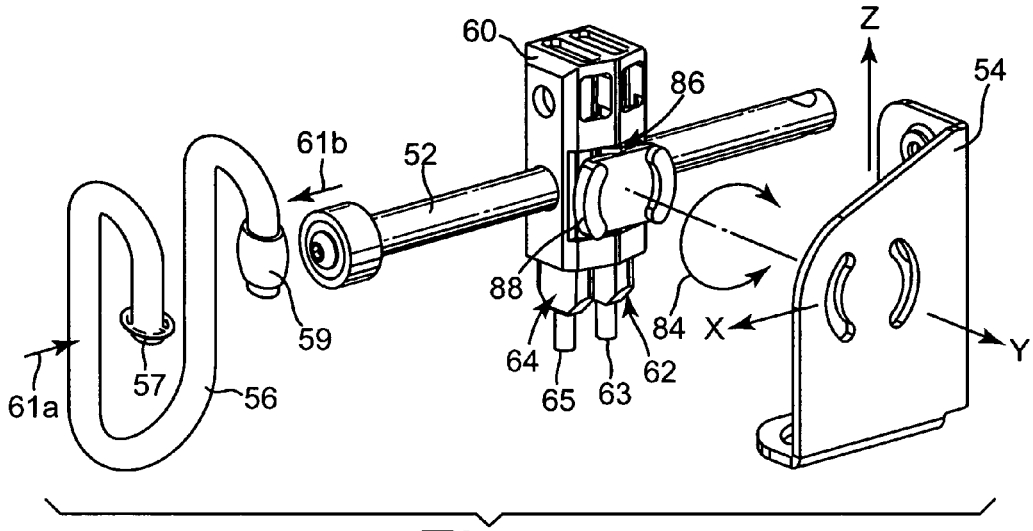
FIG. 7 illustrates a partially exploded view of a portion of the brake mechanism of FIG. 5.

FIG. 7 illustrates a portion of brake mechanism 50 in a partially exploded view. Spring 56 is illustrated disassembled from lock holder 60. First and second locking plates 62 and 64 each extend into lock holder 60, and are secured at lock holder 60 via input 52 extending through openings in the plates. The other ends of first and second locking plates 62 and 64 extend out from lock holder 60 and terminate in first and second plate tips 63 and 65. Spring 56 is provided with holding clip 57 and sleeve 59. When assembled, spring 56 applies a compression force in the direction indicated by compression force arrows 61*a* and 61*b*.

Roller 86 and detent block 88 are adjacent lock holder 60 on one of its sides. Detent block 88 is configured to interface with chassis 54. Chassis 54 has slots that are configured to receive detent block 88 such that although detent block 88 is grounded to chassis 54, it can still pivot about the y-axis as illustrated in FIG. 7. This ability to pivot in this way can compensate in certain situations when brake mechanism 50 may be mounted in a misaligned fashion.

Figure 8:
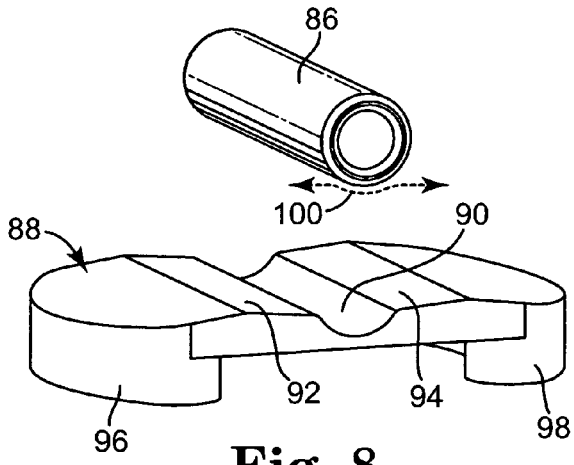
FIG. 8 illustrates a detent block and roller from the brake mechanism of FIG. 5.

FIG. 8 further illustrates roller 86 and detent block 88. Detent block includes detent 90, first and second return ramps 92 and 94, and first and second pivot bosses 96 and 98. Each of first and second return ramps 92 and 94 are angled or ramped inward toward detent 90.

When fully assembled, spring 56 is configured such that holding clip 57 secures spring 56 to lock holder 60 on one of its sides and sleeve 59 is adjacent the side of chassis 54 opposite that of lock holder 60. In this way, compression force 61 is applied by spring 56 inward toward both sides of lock holder 60. Because detent block 88 is assembled between lock holder 60 and chassis 54, it is between the compression forces 61 of spring 56. When roller 86 is resting in detent 90 (referred to as the "home position" for lock holder 60), brake mechanism 50 is normally engaged and input 52 does not move relative to chassis 54 for no or low forces applied to input 52. When first or second locking plate 62 or 64 is locked to input 52, lock holder 60 will be forced to move axially with input 52 when input 52 is moved. When a sufficient force is applied axially to input 52 (that is, the release force), roller 86 will move out of detent 90 to one of the first or second return ramps 92 or 94 of detent block 88 and deflect spring 56.

When lock holder 60 is moved in the direction indicated by arrow 72 in FIG. 5, second locking plate 64 is the leading lock. Because brake mechanism 50 is engaged, leading lock (second locking plate 64) moves with input 52, as does lock holder 60. As each move in the direction of arrow 72, second plate tip 65 of the leading lock, which extends through release opening 55 (illustrated in FIG. 5) will impact chassis 54. This will apply an external force to second locking plate 64, thereby causing second locking plate 64 to slip relative to input 52 and disengage brake mechanism 10. In this disengaged state, input 52 may move relative to chassis 54 and lock assembly 58, subject to a drag force caused by some continued contact from first and second locking plates 62 and 64.

One way for brake mechanism 50 to return or reset to its steady state position is for input 52 to travel slightly in the direction indicated by arrow 71 such that lock holder 60 can return to its home position. In embodiments where input 52 is coupled to a door, the door will return slightly in the direction opposite that it was being forced in order for brake mechanism 50 to return to its engaged state. It is not necessary to apply an external force to input 52 in this return direction, however, because once a force is removed from input 52 the compression force 61 from spring 56 will cause roller 86 to move along return ramp 92 or 94 and into detent 90, thereby returning lock holder 60 back to its home position. Again, because of the contour of return ramps 92 and 94 and detent 90, the compression force delivered by spring 56 has both an x-axis and y-axis component. In one embodiment, the drag force caused by the leading lock on input 52 is less than the x-axis component of the compression force from spring 56. Thus, slight movement of input 52 in the direction opposite that of the direction that caused the disengagement is necessary to reset or reengage brake mechanism 50.

Consequently, when brake mechanism 50 is installed on a door that is hinged to a frame, at any location of the door relative to the frame, the door will be held in a locked state while brake mechanism 50 is engaged. When the user applies enough force, that is, more than the release force to disengage brake mechanism 50, the door moves easily subject only to system drag and inertia. When the applied force is removed from the door, lock holder 60 moves back to its home position, thereby reengaging brake mechanism 50.

In one embodiment of brake mechanism 50, release opening 55 is a "D-shaped" opening to compensate for relative motion in the x-y plane. For example, as illustrated in FIG. 5, under a locked condition, input 52, second locking plate 64 (leading lock) and lock holder 60 move together as a rigid body relative to chassis 54. As described, it is the contact of second plate tip 65 against chassis 54 that allows brake mechanism 50 to disengage. Since the combination of input 52, second locking plate 64 and lock holder 60 may pivot about roller 86 in the x-y plane relative to chassis 54, release opening 55 is configured with an arc on one side to compensate for the relative motion and allow the leading lock (second plate tip 65) to slide along the arc of release opening 55.

As with brake mechanism 10, alternative embodiments of brake mechanism 50 are possible such that it may be reset externally after it is disengaged. For example, using FIG. 6 as an illustration, brake mechanism 50 can be reset and engaged by applying a force to second locking plate 64, thereby decreasing the drag force of second locking plate 64 below the compression force from spring 56 and allowing lock holder 60 to move back to its home position. Application of force to second locking plate 64 in order to reset brake mechanism 50 can be accomplished in a variety of ways consistent with the present invention. A solenoid or similar actuating device could be triggered at the appropriate time to transition against first or second locking plate 62 or 64 (depending on which is the leading plate at that time) such that brake mechanism is reset. Similarly a pin or other mechanism could be used to apply an external force to first or second locking plate 62 or 64.

The amount of compression force exerted by spring 56 on lock holder 60, detent block 88 and chassis 54 is proportional to the amount of force that must be applied to input 52 in order to move lock holder 60 block forward until the leading lock (and specifically, first or second plate tip 63 or 65) impacts chassis 54, thereby disengaging brake mechanism 50. The amount of force that must be applied to input 52 in order to disengaging brake mechanism 50 is the release force. When a force less than the release force is applied to input 52, brake mechanism 50 remains engaged. When a force greater than the release force is applied to input 52, brake mechanism 50 disengages. Because the release force is proportional to the compression force exerted by spring 56 on lock holder 60, detent block 88 and chassis 54, the release force in brake mechanism 50 is adjustable for particular applications by adjustments to the compression force of spring 56 and by adjustments to the angle of exit from detent 90. In this way, adjustments may be made to spring 56 and detent block 88 so that the release force may be tailored to the particular application of brake mechanism 50. Very similarly, the return force, that is, the force that allows lock holder 60 to move back to its home position upon reset, may also be adjusted with adjustments to the angle of exit from detent 90.

In another embodiment, brake mechanism 50 is designed with a force free zone in the same way as described previously with respect to brake mechanism 10. In this way, brake mechanism 50 may be configured to disable one or both of locking plates 62 and 64 over a specified range, using a sensor in conjunction with a pin, solenoid or other mechanism to press on the leading lock. Also, a tapered or stepped input 52, as previously discussed, could be used to accomplish disabling the locks in particular ranges.

In an alternative embodiment of brake mechanism 50, a bi-directional brake may be achieved with one locking plate interacting with appropriate force transfer and release features at either end. In other words, a pin, solenoid or other actuating mechanism can be used to press a locking plate into and out of locking position to engage and disengage brake mechanism 50. The actuating mechanism could be controlled by a positioning sensor to appropriately engage and disengage brake mechanism 50 at the desired relative positions, while having only a single locking plate.

Figure 9:
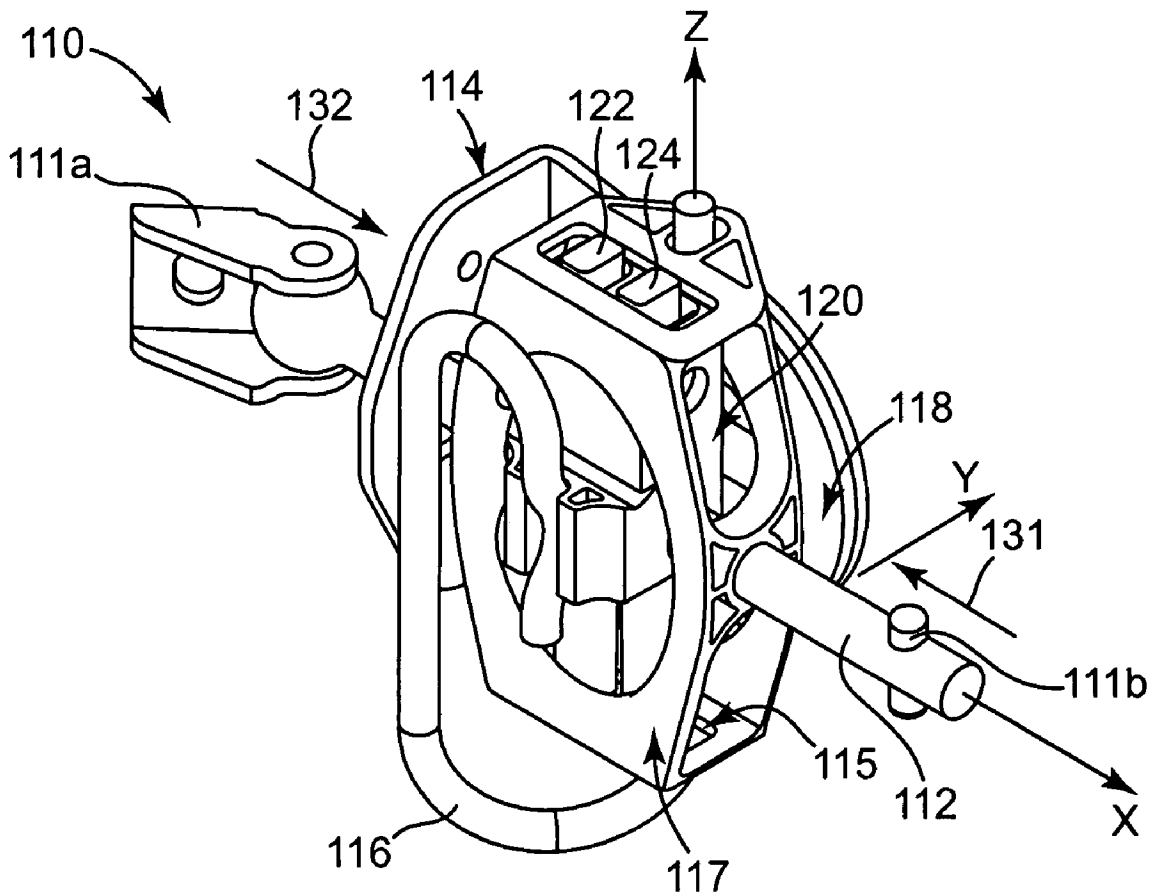
FIG. 9 illustrates an alternative embodiment of a brake mechanism in accordance with the present invention.

FIG. 9 illustrates brake mechanism 110 in accordance with an alternative embodiment of the present invention. Brake mechanism 110 includes input 112, chassis 114, spring 116, pivoting control bracket 117, spring pivot disk 118, lock holder 120, first and second locking plates 122 and 124, and bias spring 126 (not visible in FIG. 9). Pivoting control bracket 117 includes release opening 115 through which first and second locking plates 122 and 124 extend. Spring 116 is coupled at one end to lock holder 120, and its other end extends through pivoting control bracket 117 and spring pivot disk 118.

In one embodiment, brake mechanism 110 may be used similarly to brake mechanisms 10 and 50 in conjunction with a door that is hinged relative to a doorframe in order to control the movement of the door relative to the doorframe. The input to brake mechanism 110 is through input 112, which includes input attachment 11*a* at one end and limit stop 111*b* at another. Input attachment 111*a* may be coupled to the stationary doorframe while chassis 114 is coupled to the door. Alternatively, input attachment 111*a* is coupled to the door while chassis 114 is coupled to the stationary doorframe.

Input 112 passes through openings in first and second locking plates 122 and 124, which have a clearance fit about input 112. First and second locking plates 122 and 124 are spring loaded by bias spring 126 (not visible in FIG. 9). In this way, both first and second locking plates 122 and 124 are each tipped at a small angle, with respect to input 112, by bias spring 126. Thus, it can be seen that brake mechanism 110, via first and second locking plates 122 and 124, has an engaged state and a disengaged state similar to brake mechanisms 10 and 50. The locking or engagement of first and second locking plates 122 and 124 to input 112 is highly analogous to that described previously with respect to brake mechanisms 10 and 50.

In the engaged or steady state, first and second locking plates 122 and 124 grip input 112 such that a load applied to input 112 in either direction is entirely transferred through either first or second locking plate 122 or 124 to lock holder 120, which is grounded to chassis 114 via spring 116, and spring pivot disk 118 (as will be more fully explained below with respect to FIG. 10). In the disengaged state, an external load or force is applied to either first or second locking plate 122 or 124, thereby releasing the grip on input 112 and sending brake mechanism 110 into a slip condition. In this slip condition, input 112 slips through both first and second locking plates 122 and 124. As was the case with brake mechanisms 10 and 50, one of the locking plates 122 or 124 will be the leading lock while the other is the trailing lock, depending upon the direction of the applied load or force.

Figure 10:
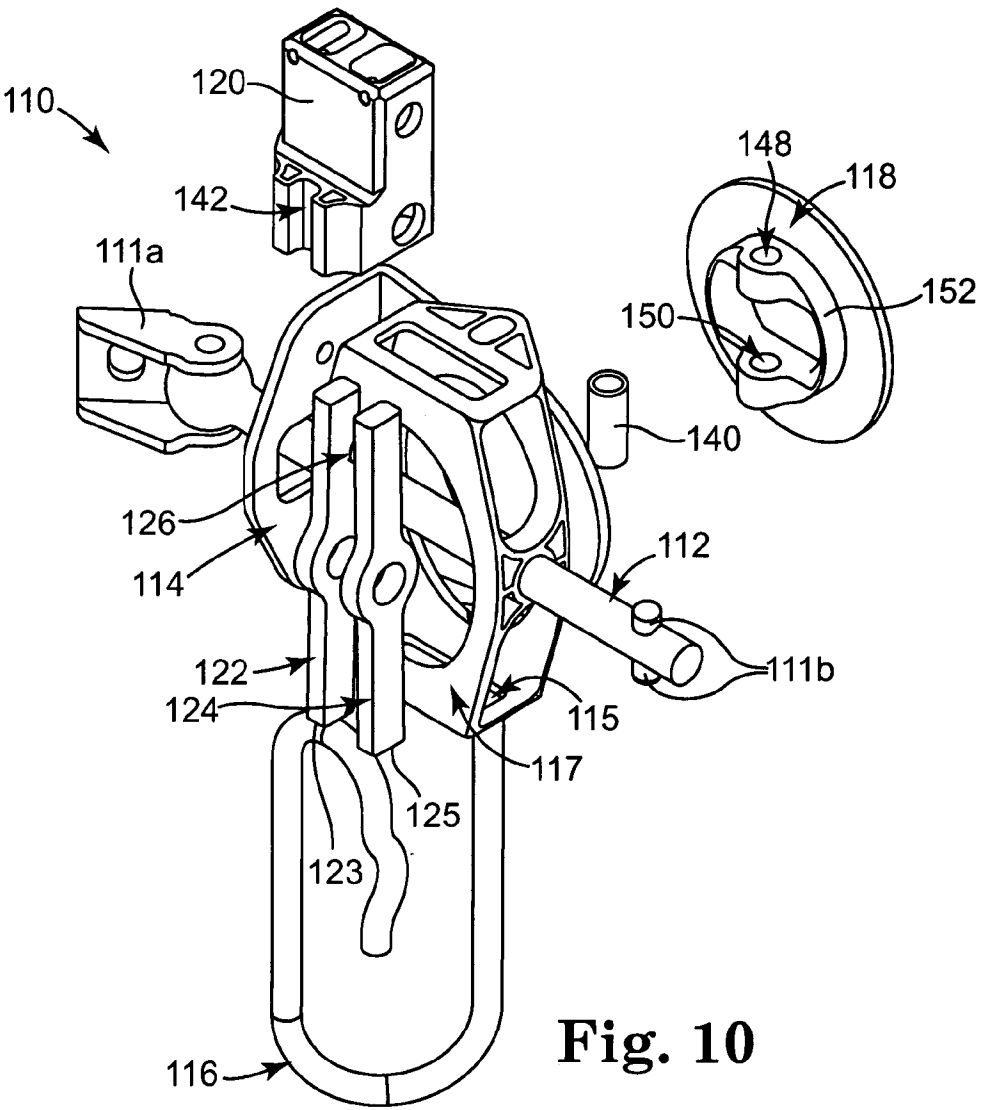
FIG. 10 illustrates a partially exploded view of the brake mechanism of FIG. 9.
Figure 11:
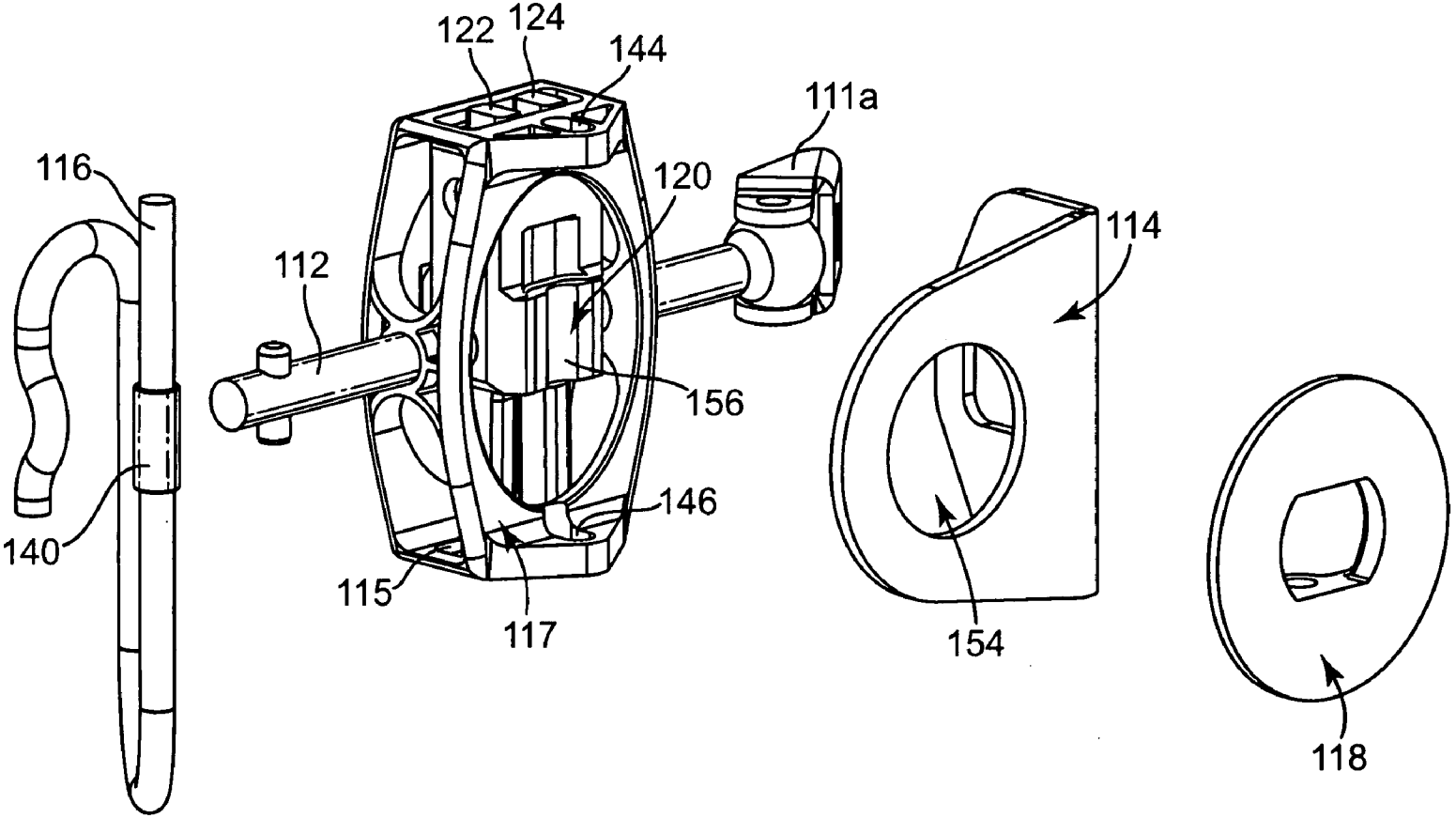
FIG. 11 illustrates a partially exploded view of the brake mechanism of FIG. 9.

FIGS. 10 and 11 illustrate brake mechanism 110, and a portion of brake mechanism 110, respectively, both in a partially exploded view. Spring 116 is illustrated in each case disassembled from lock holder 120, and it includes roller 140. First and second locking plates 122 and 124 each extend into lock holder 120, and are secured at lock holder 120 via input 112 extending through openings in the plates. The other ends of first and second locking plates 122 and 124 extend out from lock holder 120 and terminate in first and second plate tips 123 and 125.

When assembled, one end of spring 116 is clipped into a groove 142 provided on lock holder 120 and the other end extends through first and second slots 144 and 146 (illustrated in FIG. 11) of pivot control bracket 117 and through first and second slots 148 and 150 (illustrated in FIG. 10) of spring pivot disk 118. Spring 116 is extended through slots 144, 146, 148 and 150 after rim 152 of spring pivot disk 118 (illustrated in FIG. 10) is extended through opening 154 in chassis 114 (illustrated in FIG. 11) such that spring 116 holds chassis 114, pivot control bracket 117 and spring pivot disk 118 from relative movement in the y-axis direction. Because of the intersection of rim 152 through opening 154, however, relative rotation about the y-axis is allowed between chassis 114 and pivot control bracket 117 and spring pivot disk 118. This ability to pivot in this way can compensate in certain situations when brake mechanism 110 is mounted in a misaligned fashion. Furthermore, in one embodiment, attachment 11*a* is a ball-and-socket configuration allowing for further compensation in the case of misaligned mounting.

As described for previous embodiments, spring 116 provides a compression force to either side of lock holder 120. Lock holder 120 is configured with detent 156 and with ramped surfaces that are angled or ramped relative to detent 156 on either side of detent 156. Roller 140 is configured to be received in detent 156 when in its home position. Thus, when in the home position, the compression force is applied by spring 116 at groove 142 and detent 156 inward on either side of lock holder 120. When roller 140 is resting in detent 156 (the "home position" for lock holder 120), brake mechanism 110 is normally engaged and input 112 does not move relative to chassis 114 when no or little force is applied to input 112. When first or second locking plate 122 or 124 is locked to input 112, lock holder 120 will be forced to move axially with input 112 when input 112 is moved. When a sufficient force is applied axially to input 112 (that is, the release force), roller 140 will move out of detent 156, along one of the ramps on either side of detent 156 and deflect spring 116 via roller 140.

Similar to previously described designs, when lock holder 120 is moved in the x-axis direction, the leading lock (again, defined by the direction of the load or applied force), which extends through release opening 115, will impact pivoting control bracket 117. This will apply an external force on the leading lock thereby causing it to slip relative to input 112 and disengage brake mechanism 110. In this disengaged state, input 112 may move relative to chassis 114, subject to a drag force caused be some continued contact from the locks.

As with previously described embodiments, one way for brake mechanism 110 to reset and return to its steady state position is for input 112 to travel slightly back in the direction of the applied load such that lock holder 120 can return to its home position. In embodiments where input 112 is coupled to a door, the door will return slightly in the direction opposite that it was being moved in order for brake mechanism 110 to return to its engaged state. Again, it is not necessary to apply an external force to input 112 in this return direction, however, because once a force is removed from input 112 the compression force from spring 116 will cause roller 140 to move into detent 156, thereby returning lock holder 120 back to its home position.

Consequently, when brake mechanism 110 is installed on a door that is hinged to a frame, at any location of the door relative to the frame, the door will be held in a locked state while brake mechanism 110 is engaged. When the user applies enough force, that is, more than the release force to disengage brake mechanism 110, the door moves easily subject only to system drag and inertia. When the applied force is removed from the door, lock holder 120 moves back to its home position, thereby reengaging brake mechanism 110.

With pivoting control bracket 117 between chassis 114 and lock holder 120 with detent 156, brake mechanism 110 eliminates relative motion or rotation between release opening 115 and first and second plate tips 123 and 125. In this way, release opening 115 can have a rectangular or similar shape. Unlike brake mechanism 50, no arc or similar shape is needed for the release opening, because there is no relative rotation between release opening 115 and first and second locking plates 122 and 124. This is because release opening 115 is provided in pivoting control bracket 117 rather than in chassis 114.

In addition to its pivoting capability, control bracket 117 is also to translate in the y-axis direction via its connection to spring 116. In this way, it cooperates with lock holder 120 and roller 140 to help provide the clearance needed for roller 140 to move in and out of detent 142.

As with brake mechanisms 10 and 50, alternative embodiments of brake mechanism 50 are possible such that it may be reset externally after it is disengaged. For example, using FIG. 9 as an illustration, brake mechanism 110 can be reset and reengaged by applying an external force to second locking plate 124, thereby decreasing the drag force of second locking plate 124 below the compression force from spring 116 and allowing lock holder 120 to move back to its home position. Applying a force on second locking plate 124 to reset brake mechanism could be accomplished in a variety of ways consistent with the present invention. A solenoid or similar actuating device could be triggered at the appropriate time to transition against first or second locking plate 122 or 124 (depending on which is the leading plate at that time) such that brake mechanism is reset. Similarly a pin or other mechanism could be used to apply an external force against first or second locking plate 122 or 124.

The amount of compression force exerted by spring 116 on lock holder 120 is proportional to the amount of force, that is, the release force that must be applied to input 112 in order to move lock holder 120 forward until the leading lock impacts pivoting control bracket 117, thereby disengaging brake mechanism 110. Consequently, adjustments may be made to spring 116, or detent 142, each as previously described, so that the release force may be tailored to the particular application of brake mechanism 110. Very similarly, the return force, that is, the force that allows lock holder 120 to move back to its home position upon reset, may also be adjusted with adjustments to detent 142.

In another embodiment, brake mechanism 110 is designed with a force free zone in the same way as described previously with respect to brake mechanism 50. In this way, brake mechanism 110 may be configured to disable one or both of locking plates 122 and 124 over a specified range, using a sensor in conjunction with a pin, solenoid or other mechanism to press on the leading lock. Also, a tapered or stepped input 112, as previously discussed, could be used to accomplish disabling the locks in particular ranges.

Figure 12:
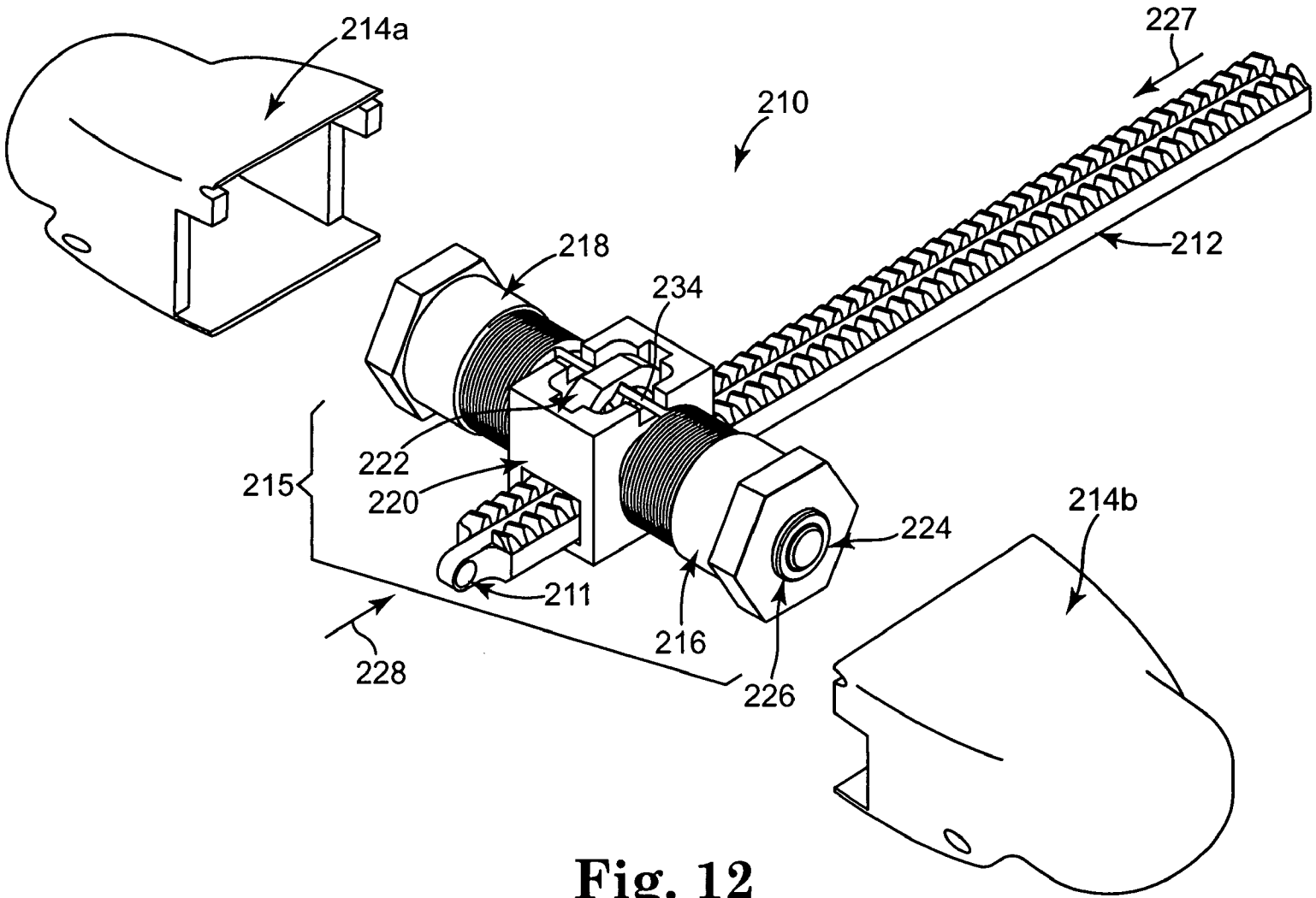
FIG. 12 illustrates an alternative embodiment of a brake mechanism in accordance with the present invention.

FIG. 12 illustrates brake mechanism 210 in accordance with an alternative embodiment of the present invention. Brake mechanism 210 includes input 212, chassis or housing 214 (illustrated separated into two portions 214*a* and 214*b*), and shaft assembly 215. Shaft assembly 215 further includes first and second clutch brake assemblies 216 and 218, release slide 220, shaft 224 and retaining collar 226. Release slide 220 includes release ring 222, which is configured to slide within a groove 213 within input 212.

In one embodiment, brake mechanism 210 may be used similarly to brake mechanisms 10, 50 and 110 in conjunction with a door that is hinged relative to a doorframe in order to control the movement of the door relative to the doorframe. The input to brake mechanism 210 is through input 212, which includes input feature 211 at one end. Input feature 211 may be coupled to the stationary doorframe. Housing 214, illustrated in two sections in FIG. 12, is coupled together in a single-piece configuration that contains shaft assembly 215, and is coupled to the door. Alternatively, input feature 211 may be coupled to the door while housing 214 is coupled to the stationary doorframe.

Input 212 passes through an opening in housing 214 and through release slide 220. In one embodiment, input 212 is a helical rack that slides through release slide 220. A helical pinion 230 (not visible in FIG. 12) engages and meshes with helical rack 212 as it moves through release slide 220. First and second clutch brake assemblies 216 and 218 cooperate with helical pinion 230 such that they can variably prevent rotation thereof. Thus, bidirectional capability is provided by first clutch brake assembly 216 providing braking and releasing function when a load is removed and applied in the direction indicated by arrow 228, and by second clutch brake assembly 218 providing braking and releasing function when a load is removed and applied in the direction indicated by arrow 227. In this way, it can be seen that brake mechanism 210 has an engaged state and a disengaged state, similar to brake mechanisms 10, 50 and 110.

Figure 13:
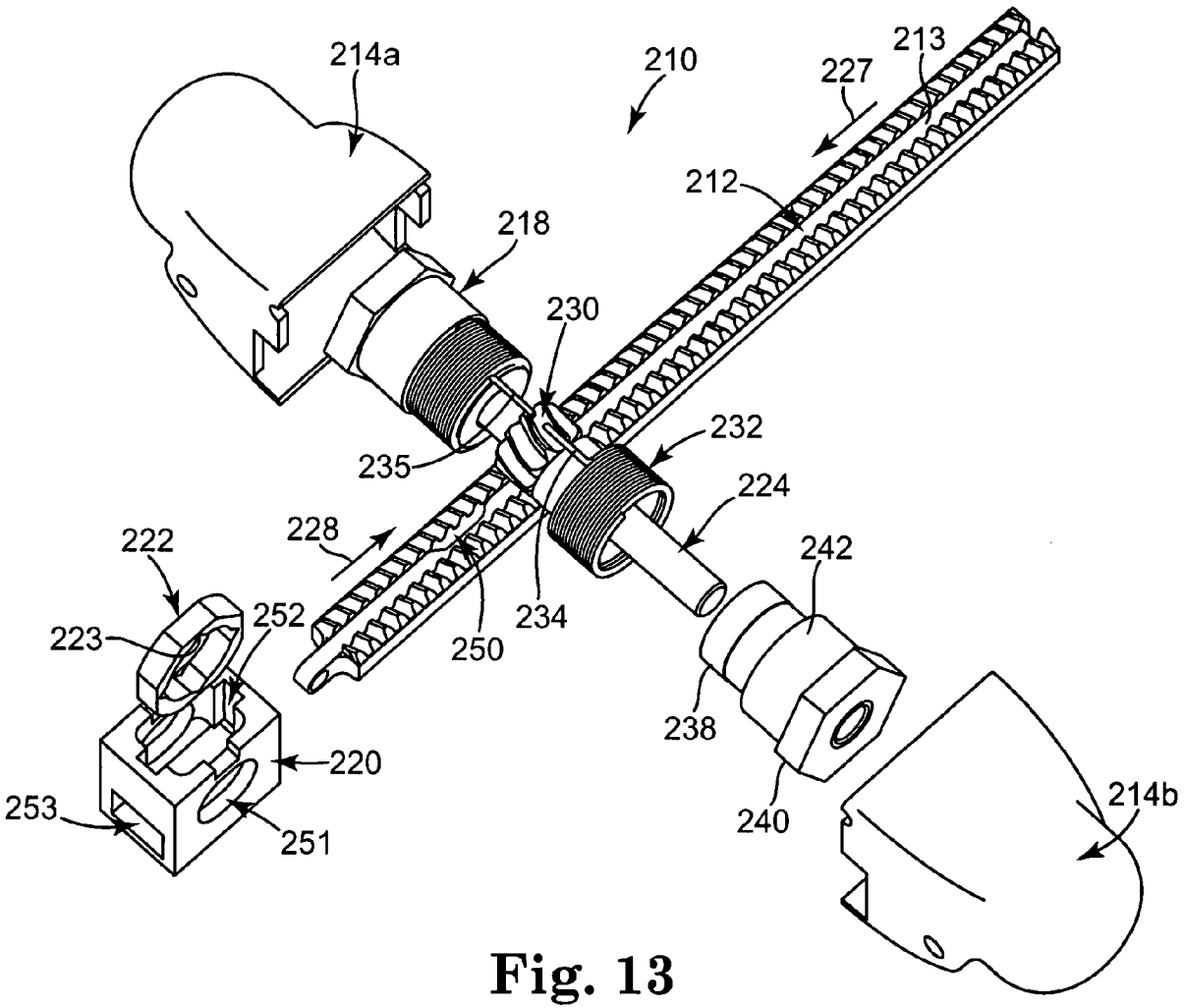
FIG. 13 illustrates a partially exploded view of the brake mechanism of FIG. 12.

FIG. 13 illustrates brake mechanism 210 in a partially exploded view. Shaft 224 is illustrated extending through first and second clutch brake assemblies 216 and 218. First and second clutch brake assemblies 216 and 218 of shaft assembly 215 are mirrored about helical pinion 230 such that each provide functionality in one direction of travel (illustrated by arrows 227 and 228) of shaft assembly 215 on input 212. Helical pinion 230 is coupled to shaft 224 between them. First clutch brake assembly 216 is illustrated in exploded view, including wrap spring 232, toe 234, wrap hub 238, clutch case 242, and clutch base 240. Clutch base 240 is grounded to housing 214. In one embodiment, clutch base 240 is hex-shaped and engages housing 214 to prevent relative rotation.

Release slide 220 includes input slot 253 into which input 212 is received, and shaft slot 251 through which shaft assembly 215 extends. Release slide 220 also includes slot 252 into which release ring 222 is received. Release ring 222 includes notch 223 which is configured to receive toes 234 and 235.

Figure 14:
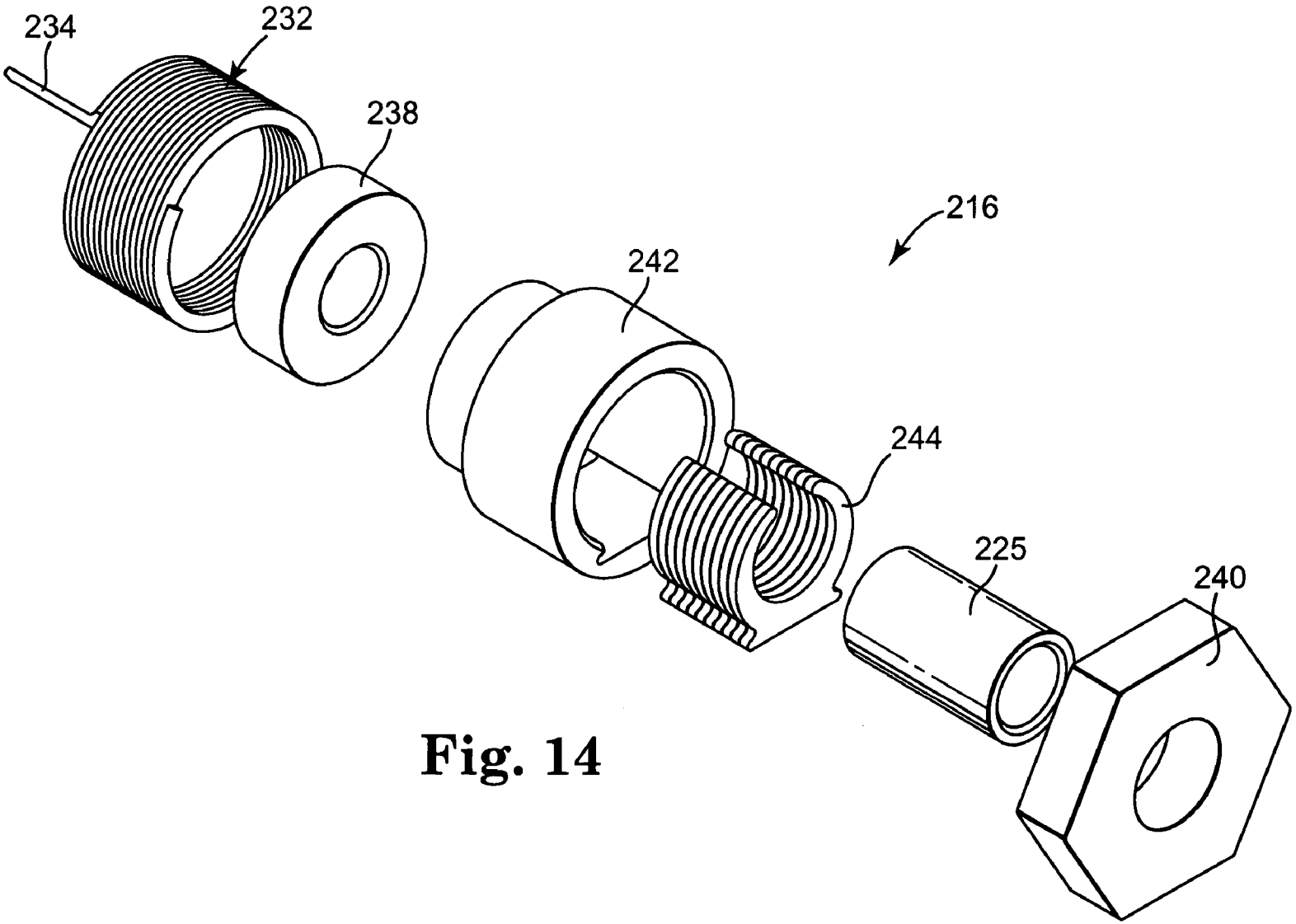
FIG. 14 illustrates a partially exploded view of a portion of the brake mechanism of FIG. 12.

FIG. 14 illustrates first clutch brake assembly 216 further exploded so that additional detail can be illustrated and explained. It should be recognized that the details of second clutch brake assembly 218 are symmetrical to first clutch brake assembly 216, and as such, they will not be described separately from first clutch brake assembly 216. First clutch brake assembly 216 includes wrap spring 232, wrap hub 238, clutch case 242, a plurality of clips 244, shaft 225 and clutch base 240. Wrap spring 232 also includes toe 234. When assembled, clips 244 fit within a slot in clutch case 242 that matches the profile of the clips 244 such that there is no relative rotation between clips 244 and clutch case 242. Shaft 225 fits within an opening within clips 244 and has a diameter slightly larger than the opening such that the clips 244 frictionally engage shaft 225 with a compression force. This compression force can be specifically adjusted and controlled by varying the number of clips pressed onto shaft 225. Wrap hub 238 and helical pinion 230 are press fit on shaft 224.

In operation, first clutch brake assembly 216 functions as a conventional wrap spring brake. Wrap spring 232 is wound such that it is wrapped down on wrap hub 238 and clutch case 242 engaging brake mechanism 210. In this case, release mechanism 220 is in its home position and brake mechanism 210 is engaged. When force is applied to input 212 in direction 228, input 212 will tend to move in this direction as well. Because helical pinion 230 engages input 212, it will thus also rotate with movement of input 212.

Figure 15:
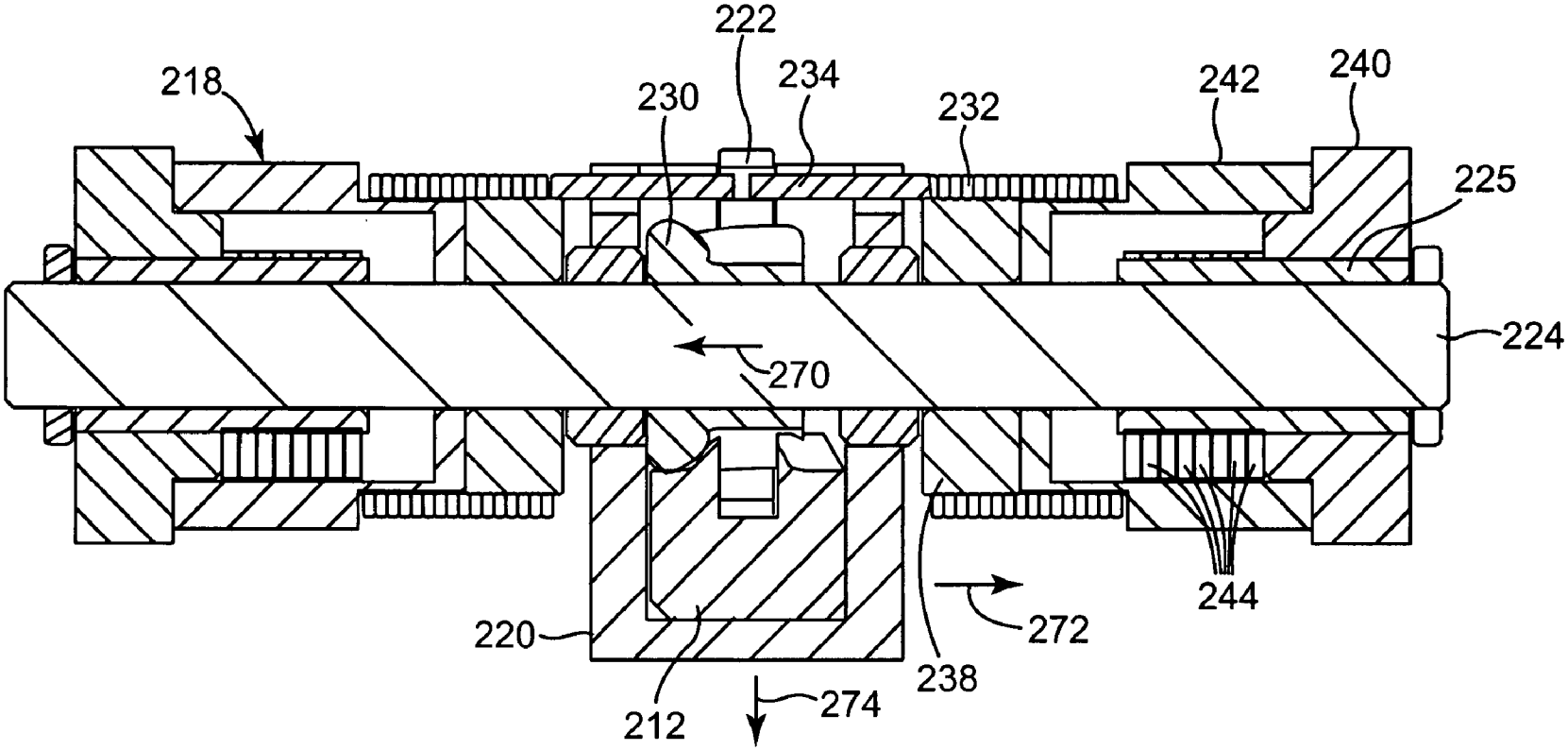
FIG. 15 illustrates a cross-sectional view of a portion of the shaft assembly of the brake mechanism of FIG. 12.

FIG. 15 illustrates a cross-sectional view of a portion of shaft assembly 215 and illustrates the relative movement of helical pinion 230 and input 212. Helical pinion 230 and input 212 are illustrated within release slide 220. Because of their helical configuration, application of force on input 212 in direction 228 drives helical pinion 230 in direction 270 and drives input 212 in directions 272 and 274, thereby forcing both helical pinion 230 and input 212 against interior surfaces of release slide 220 (albeit opposing sides.) If the force applied to input 212 is sufficiently high, release slide 220 will be forced from its home position and move axially with input 212. Since shaft slot 251 is configured to be of a larger size than the portion of shaft assembly 215 extending through it so that release slide 220 is allowed to move axially with input 212. As release slide 220 moves in direction 228 of the applied force, toe 234 engages notch 223 and is also therefore moved in direction 228, thereby wrapping open wrap spring 232. This disengages brake mechanism 210.

When a force is initially applied to input 212 and brake mechanism 210 is in an engaged state, rotation of helical pinion 230 must be allowed in order to move release slide 220 to disengage brake mechanism 210 as just described. This rotation is allowed when enough applied force (that is, a release force) is applied to overcome the compression force of clips 244 on shaft 225. For example, when the force that is applied in the direction of arrow 228 is greater than the compression force of clips 244 on shaft 225, it will cause shaft 225 to slip within clips 244. The force on input 212 in direction 228 rotates helical pinion 230 counter clockwise. Because helical pinion 230 and wrap hub 238 are press fit on shaft 224, wrap hub and shaft 224 also so rotate. Because wrap spring 232 is wrapped down on wrap hub 238 and clutch case 242, clutch case 242 also rotates. Because shaft 225 is grounded to clutch base 240, which is in turn grounded to housing 214, clips 244 must slip relative to shaft 225. Thus, it can be seen that the release force must be greater that the compression force to allow brake mechanism 210 to disengage.

The amount of compression force exerted by clips 244 on shaft 225 is proportional to the amount of force, that is, the release force that must be applied to input 212 in order to rotate pinion 230, and move release slide 220 in order to engage toe 234 against release ring 222, thereby disengaging brake mechanism 210. Consequently, adjustments may be made to clips 244, that is, adding or subtracting the number of clips, so that the release force may be tailored to the particular application of brake mechanism 210.

These engaged and disengaged conditions described above for brake mechanism 210 with respect to first clutch brake assembly 216 and force applied in direction 228 are essentially the same as the engaged and disengaged conditions for brake mechanism 210 with respect to second clutch brake assembly 218 and force applied in direction 227. Thus, the engaged and disengaged conditions for brake mechanism 210 with respect to second clutch brake assembly 218 will not be separately described. However, it should be recognized that it is the combination of first and second clutch brake assemblies 216 and 218 that give brake mechanism 210 its bidirectional capabilities.

In one embodiment, a spring or similar mechanism may be added to help return release block 220 to its home position after brake mechanism 210 is disengaged, in order to reset or reengage brake mechanism 210. Forcing release block 220 back slightly in the opposite direction as the force applied that caused the release will reset brake mechanism 210. As such, toe 234 is released and wrap spring 232 can wrap back down onto wrap hub 238 and clutch case 242. Once a force is removed from input 212 wrap spring 232 will return to its normal wrap down state.

In one embodiment where brake mechanism 210 is installed on a door that is hinged to a frame, at any location of the door relative to the frame, the door will be held in a locked state while brake mechanism 210 is engaged. When the user applies enough force, that is, more than the release force to disengage brake mechanism 210, the door moves easily subject only to system drag and inertia. Brake mechanism 210 then reengages when the applied force is removed from the door.

Similar to that described for previous embodiments, brake mechanism 210 is configured with a home position. In this position, release block 220 is situated such that wrap spring 232 is wrapped down on wrap hub 238 and clutch case 242. When in the home position, the wrap down force applied locks pinion 230 from rotating freely (that is, disengaged from clips 244) such that brake mechanism 210 is engaged and input 212 does not move relative to housing 214.

When wrap spring 232 is deflected by toe 234 impacting notch 223 of release ring 222 as release block 220 is moved along input 212, this will release wrap spring 232 and thus pinion 230, thereby allowing relative movement of pinion 230 and input 212 disengaging brake mechanism 210. In this disengaged state, input 212 may move relative to housing 214, subject to a drag force caused be some continued contact from wrap spring 232 and the other wrap spring.

As with brake mechanisms 10, 50 and 110, alternative embodiments of brake mechanism 210 are possible such that it may be reset externally after it is disengaged. For example, using FIG. 12 as an illustration, brake mechanism 210 can be reset and engaged by displacing toe 234 of wrap spring 232 a small distance so it wraps back down onto wrap hub 238 and clutch case 242. Displacing toe 234 of wrap spring 232 to reset brake mechanism 212 could be accomplished in a variety of ways consistent with the present invention. A solenoid or similar actuating device could be triggered at the appropriate time to transition against toe 234 (assuming second clutch brake assembly 218 is disengaged via a force applied in direction 227, a similar device could be applied to first clutch brake assembly 216 when a force applied in direction 228). In this way, brake mechanism is reset. Similarly, release ring 222 could be manipulated to move and release toes 234 and 235.

In another embodiment, brake mechanism 210 is designed with a force free zone similar to that described previously with respect to brake mechanisms 10, 50 and 110. In this way, brake mechanism 210 may be configured to disable one or both of clutch brake assemblies 216 or 218 over a specified range, using a sensor in conjunction with a pin, solenoid or other mechanism to press on the toe.

Also, a feature 250 in groove 213 of input 212 may be used to disable clutch brake assemblies 216 or 218 over particular ranges. As release slide 220 moves along input 212, release ring 222 will slide within groove 213. A compression spring or similar force mechanism may be used to force release ring 222 down slot 252 within release slide 220 such that release ring 222 is kept flush with the surface of groove 213. When release ring 222 encounters feature 250 and is forced down into it, toes 234 and 234 will be locked into engagement with release ring 222, thereby forcing the disengagement of first and second clutch brake assemblies 216 and 218. Brake mechanism 210 will not be allowed to engage again until release ring 222 moves out of feature 250.

Although, the present invention has been described with reference to preferred embodiments, workers skilled in the art will recognize that changes may be made in form and detail without departing from the spirit and scope of the invention. For example, although brake mechanisms 10, 50, 110 and 210 were illustrated previously with reference to connection to a stationary door frame and door, one skilled in the art will recognize that various other applications for the brake mechanisms are possible consistent with the invention.

Such brake mechanisms could be installed in a wide variety of applications from regulating sliding doors to adjusting the seat height on a bicycle. For example, in the bicycle seat application, a brake mechanism could be installed relative to the bicycle seat and set to normally be in a locked state. The override feature described previously would then provide the user with a load-free zone, where the locks could be disabled thereby disengaging the brake and allowing easy adjustment of the seat. With such an embodiment, a pin, solenoid or other mechanism can be used to press on the locking plates or toes such that the lock releases the input. In this way, the brake mechanism may be released or reset, such that lock holder 20 moves back to its home position similar to that described previously. Consequently, the input may move through lock with minimal drag.

What is claimed is:

1. A brake mechanism comprising:

an axially extending input having first and second ends;

a chassis interfacing with the input such that the input moves relative to the chassis upon application of an external force on the input;

a lock holder coupled to the chassis;

a lock configured within the lock holder for constraining movement of the input relative to the lock; and a release mechanism coupled between the lock holder and the chassis that provides a compression force on the lock holder, the release mechanism responsive to the external force applied to the input;

wherein the lock holder is in communication with the compression force such that when the external force applied to the input is greater than the compression force, the lock holder and lock move with the input and such that when the external force applied to the input is less than the compression force, the lock holder and lock are prevented from moving with the input; and wherein the lock holder and lock are configured such that when the lock holder and the lock move with the input as the external force is applied, the lock engages the chassis such that the lock releases its constraint of the input thereby allowing relative movement of the input and lock.

2. The brake mechanism of claim 1, wherein the first end of the input is coupled to a first body, the chassis is coupled to a second body that is movable relative to the first body, and wherein the applied force is applied to the second body.

3. The brake mechanism of claim 2, wherein the first body is an automobile door frame, the second body is an automobile door hinged to the door frame, and wherein the applied force is applied to the automobile door.

4. The brake mechanism of claim 3 configured such that the automobile door is held and braked at any location relative to the door frame.

5. The brake mechanism of claim 1, wherein the lock includes first and second locking plates, each having an opening through which the input extends, and wherein constraining movement of the input relative to the lock is caused by contact between the locking plates and the input.

6. The brake mechanism of claim 5, wherein the release mechanism includes a spring that provides the compression force and wherein the external force must be greater than the compression force to disengage the lock.

7. The brake mechanism of claim 6, wherein the lock holder is configured with slots for holding the first and second locking plates.

8. The brake mechanism of claim 7 further configured such that when the lock holder and plates move with the input, the external force is applied to the first or second locking plate thereby causing it to slip relative to the input.

9. The brake mechanism of claim 7 further configured such that when the lock holder and plates move with the input the first or second locking plate will impact the chassis thereby causing it to slip relative to the input.

10. The brake mechanism of claim 7 further configured such that, dependant on the direction of the applied force, one of the first or second locking plates is a leading lock gripping the input and the other is a trailing lock.

11. The brake mechanism of claim 8 further configured such that when the applied force is greater than the compression force, application of an external force to the leading lock will cause the plates to release the input.

12. A brake mechanism for controllably regulating relative motion between a first body and a second body, the brake mechanism comprising:

an axially extending input having first and second ends, the first end being coupled to one of the first and second bodies;

a chassis coupled to the other of the first and second bodies, the chassis configured to interface with the input and configured such that the input and the chassis are movable relative to each other upon application of a force to one of the first and second bodies;

a lock holder coupled to the chassis;

a lock configured within the lock holder, the lock having a first state in which the lock constrains movement of the input relative to the lock and the lock having a second state in which the lock allows movement of the input relative to the lock; and a release mechanism coupled between the lock holder and the chassis that provides a compression force on the lock holder, the release mechanism responsive to the force applied to the first body such that when the applied force is greater than the compression force the release mechanism causes the lock to be in the second state and such that when the applied force is less than the release force the release mechanism causes the lock to be in the first state.

13. The brake mechanism of claim 12, wherein the first body is a door frame, the second body is a door hinged to the door frame, and wherein the applied force is applied to the door.

14. The brake mechanism of claim 12, wherein the second body is a door frame, the first body is a door hinged to the door frame, and wherein the applied force is applied to the door.

15. The brake mechanism of claim 12, wherein the release mechanism includes a spring that provides a compression force and wherein the applied input force must be greater than the compression force to disengage the lock.

16. A brake mechanism for controllably regulating relative motion between a first body and a second body, the brake mechanism comprising:

an axially extending input having first and second ends, the first end being coupled to the first body;

a chassis coupled to the second body, the chassis configured to interface with the input and configured such that the input and chassis are movable relative to each other upon application of a force relative to the first and second bodies;

a lock holder configured adjacent the chassis and having a first recess;

a force mechanism configured between the chassis and the lock holder and applying a compression force on the lock holder;

a first locking plate received within the recess of the lock holder and configured to engage the input when the force applied relative to the first and second bodies is less than the compression force.

17. The brake mechanism of claim 16, further including a second recess configured within the lock holder and a second locking plate received within the second recess of the lock holder, wherein the first locking plate is configured to variably engage the input dependant upon the force applied relative to the first and second bodies when the force is applied in a first direction and wherein the second locking plate is configured to variably engage the input dependant upon the force applied relative to the first and second bodies when the force is applied in a second direction.

18. The brake mechanism of claim 16, wherein the first body is a door frame, the second body is a door hinged to the door frame, and wherein the applied force is applied to the door.

19. The brake mechanism of claim 16, further including a pivoting control bracket supported on the input and relative to the chassis and the lock holder such that the pivoting control bracket can pivot relative to the chassis upon relative motion of the first and second bodies.

20. The brake mechanism of claim 16, wherein the input is a shaft and wherein the force mechanism is a spring.

21. The brake mechanism of claim 20, wherein the lock holder includes a ramped surface with a detent.

22. The brake mechanism of claim 21, wherein the lock holder and the ramped surface with detent is contained within the spring such that the spring generates the compression force inward toward, and acting upon, the lock holder and ramped surface with detent.

23. The brake mechanism of claim 22, wherein a component of the compression force, a holding force, acts in an axis that is generally in the same direction as the force applied relative to the first and second bodies.

24. The brake mechanism of claim 23, wherein the plate engages the input when the holding force is greater than the force applied relative to the first and second bodies, and wherein the plate engages the chassis and thereby slips relative to the input when the holding force is greater than the force applied relative to the first and second bodies.

25. A brake mechanism for controllably regulating relative motion between a first body and a second body, the brake mechanism comprising:

an axially extending shaft having first and second ends, the first end being coupled to the first body;

a chassis coupled to the second body, the chassis configured to interface with the shaft and configured such that the shaft is movable relative to the chassis upon application of an external force;

a force generator that generates a compression force, the force generator configured for engagement with the chassis;

a lock holder configured to receive the compression force from the force generator, the lock holder having a first and a second recess;

first and second locking plates received within the first and second recesses of the lock holder that are each configured with openings through which the shaft extends;

a detent feature in the lock holder that is in communication with the force generator such that the compression force acts on the detent feature preventing relative movement of the lock holder and chassis until the external force overcomes the compression force acting on the detent feature thereby causing relative movement of the lock holder and chassis, which in turn allows the plates to release the shaft when the plates impact the chassis.

26. A brake mechanism comprising:

an axially extending input having first and second ends;

a chassis interfacing with the input such that the input moves relative to the chassis upon application of an external force on the input;

lock holder coupled to the chassis;

a lock configured within the lock holder for variably constraining movement of the input relative to the lock holder; and a release mechanism coupled between the chassis and the lock holder, the release mechanism configured to provide a compression force on the lock holder such that the lock holder is held relative to the chassis by the compression force until the external force on the input exceeds the compression force, in which case the lock holder moves relative to the chassis;

wherein the movement of the lock holder relative to the chassis causes the lock to engage the chassis and release from the input.

* * * * *